United States Patent [19]

Krambeck et al.

[11] Patent Number: 4,978,440

[45] Date of Patent: Dec. 18, 1990

[54] QUENCHED CATALYTIC CRACKING PROCESS

[75] Inventors: Frederick J. Krambeck, Cherry Hill; Joe E. Penick, Princeton, both of N.J.; Paul H. Schipper, Wilmington, Del.

[73] Assignee: Mobil Oil Corporation, New York, N.Y.

[21] Appl. No.: 463,831

[22] Filed: Jan. 8, 1990

Related U.S. Application Data

[63] Continuation of Ser. No. 272,196, Nov. 16, 1988, abandoned, which is a continuation-in-part of Ser. No. 666,533, Oct. 30, 1984, abandoned.

[51] Int. Cl.[5] ..... C10G 11/18

[52] U.S. Cl. ..... 208/113; 208/48 Q; 208/159

[58] Field of Search ..... 208/113, 159, 48 Q

[56] References Cited

U.S. PATENT DOCUMENTS

| | | | |
|---|---|---|---|
| 2,427,112 | 9/1947 | Tyson | 208/159 |
| 2,458,862 | 1/1949 | Krebs | 208/159 |
| 2,730,508 | 1/1956 | Peet | 208/159 |
| 3,074,878 | 1/1963 | Pappas | 208/127 |
| 3,113,095 | 12/1963 | Braca et al. | 208/153 |
| 3,355,380 | 11/1967 | Luckenbach | 208/153 |
| 4,149,964 | 4/1979 | Bartholic | 208/153 |
| 4,419,221 | 12/1983 | Castagnos et al. | 208/155 |
| 4,624,771 | 11/1986 | Lane et al. | 208/113 |
| 4,764,268 | 8/1988 | Lane | 208/113 |
| 4,786,400 | 11/1988 | Farnsworth | 208/80 |
| 4,818,372 | 4/1989 | Mauleon et al. | 208/113 |

*Primary Examiner*—Anthony McFarlane

*Attorney, Agent, or Firm*—Alexander J. McKillop; Charles J. Speciale; Richard D. Stone

[57] ABSTRACT

A fluidized catalytic riser cracking process is disclosed wherein a quench stream, preferably water or steam, is injected downstream of the riser reactor outlet to decrease the residence time and temperature of a majority of the hydrocarbons in a reactor vessel accepting a riser reactor effluent.

20 Claims, 1 Drawing Sheet

CLOSED CYCLONE

QUENCHED CATALYTIC CRACKING PROCESS

BACKGROUND OF THE INVENTION

1. Cross-Reference to Related Application

This is a continuation of copending application Ser. No. 272,196, filed on Nov. 16, 1988, now abandoned, which is a continuation-in-part of prior copending application Ser. No. 666,533, filed on Oct. 30, 1984 now abandoned.

FIELD OF THE INVENTION

This invention relates to an improved fluidized catalytic cracking process, and in particular to an all riser reactor FCC unit operating with quench, preferably steam quench in the catalyst/cracked vapor disengaging space downstream of the riser reactor.

BACKGROUND OF THE INVENTION

The fluidized catalytic cracking, or FCC, process is one of the work horses of modern refineries.

In somewhat oversimplified terms, hot catalyst contacts a relatively heavy oil feed, producing coked catalyst and cracked products. The coked catalyst is regenerated by burning the coke from coked catalyst in a regenerator. The catalyst is heated during the regeneration, because the coke burns. The hot regenerated catalyst is recycled to contact more heavy oil feed.

In 1940's vintage FCC units, the heavy oil feed contacted the catalyst in a relatively short transfer line which mixed the catalyst and oil together, and discharged the catalyst/oil mixture into a dense bed reactor.

Gradually refiners learned that riser cracking (with a very short residence time, typically on the order of under ten seconds) was more beneficial than dense bed cracking (with catalyst/oil residence times on the order of 10 seconds–60 seconds or more).

The desired reactions happened quickly in the catalyst riser. Some additional conversion occurred in the dense bed reactor, but a significant amount of overcracking also occurred in the dense bed and in the reactor vessel.

Modest conversions of feed to fuel oil and gasoline fractions occurred in the riser reactor. Very modest incremental conversion of feed to lighter components was obtained in the dense bed reactor, but there was also a significant amount of cracking of very valuable gasoline and fuel oil components to coke and light gases.

Accordingly refiners have attempted to maximize riser cracking, and minimize dense bed cracking. Generally this has been done by extending the catalyst riser and cutting down on the amount of catalyst inventory in the relatively large vessel into which the riser reactor discharged.

Some FCC units have attempted to practically eliminate dense bed cracking, by causing the riser reactor to discharge into a rough cut cyclone, or to discharge down toward the dense bed without agitating it, whereby substantial separation of cracked products from deactivated catalyst can be quickly obtained. Such an approach is shown in U.S. Pat. No. 3,785,962, which is incorporated by reference.

Because of the number and size of FCC units in modern refiners, with over 5 million barrels per day of FCC capacity in the USA alone, there has been tremendous incentive to improve this process even more.

A profound improvement was the shift to the use of zeolite based catalyst which resulted in a tremendous increase in catalyst activity.

Another development was the CO-afterburning regenerator which resulted in more complete combustion of coke to $CO_2$, rather than CO, in the FCC regenerator.

U.S. Pat. No. 4,072,600, of which is incorporated by reference, disclosed adding Pt, Pd, etc. to the circulating catalyst inventory to promote afterburning of CO to $CO_2$ in the FCC regenerator. This led to higher regenerator temperatures, hotter catalyst, and reduced yields of coke.

Although quenching the reactor vessel was ignored, the problem of coke formation in the top of the reactor vessel has not been ignored.

It is well-known in FCC processing that there are four kinds of "coke" which are produced during the course of the FCC reaction. Refiners have long known, but rarely discussed, a fifth kind of coke production which occurs generally downstream of the FCC reactor zone. This fifth type of coke was reported and extentively discussed in REACTOR COKING PROBLEMS IN FLUID CATALYTIC CRACKING UNITS, L. J. McPherson, in a paper presented at the Ketjen Catalyst Symposium, May 27–30, 1984, Amsterdam The Netherlands.

The author reported that coking occurs in dead spaces in FCC reactor vessels, and that the problem of coke formation was most severe when a riser cracking FCC unit was in use. This coke adheres to internal surfaces of the reactor and downstream equipment and causes many problems. Not only does this coke represent a safety hazard (the coke burns when the reactor vessel is opened for inspection) but can cause an unplanned shutdown of the unit when large coke deposits, in the order of several feet in thickness, break off and plug various process lines. This article is incorporated herein by reference.

The author reported overcoming coke deposition in dead spaces in the reactor vessel by adding minor amounts of purge steam to the dome or top of the reactor.

Although not reported in the article, it is believed that many FCC operators, whether using riser cracking FCC units, or older units including some or all dense bed cracking, add minor amounts of steam purge to the top of the reactor vessel to minimize the buildup of coke in dead spaces, such as the "dome," in the top of reactor vessel, and to minimize somewhat coking in the transfer line intermediate the reactor and the main fractorator.

Addition of purge steam in this way minimizes formation of coke in the dome of the reactor, but does not change conditions in the bulk of the reactor vessel. This is because steam flows up in the vessel. Steam added to the dome does not do anything to the vapors below, because the steam goes up, not down.

The dome represents a small fraction of the volume of a typical reactor vessel, typically only one-fifth to one-tenth of the volume of the vessel is in the dome. Adding purge steam to the dome of a "closed cyclone" FCC can quench thermal reactions in the dome, but unselective thermal reactions would be undiminished in the remaining 80–90% of the vapor space of the vessel. Many refiners add dome steam without quenching the dome significantly. They add hot, dry purge steam to the dome, in the belief that localized cooling would lead to increased coke formation.

We realized that other workers in this area overlooked one problem, or if they recognized the problem, failed to see its solution.

The problem was the thermal cracking that occurred after riser cracking but before the cracked products could be removed from the reactor vessel and subjected to conventional product recovery techniques.

We discovered a way to significantly minimize the unnecessary losses of valuable normally liquid products which occurred due to thermal cracking after riser cracking had been completed, but before the cracked product could be removed from the reactor and subjected to conventional product recovery.

BRIEF SUMMARY OF THE INVENTION

Accordingly the present invention provides a fluidized catalytic cracking process wherein a fluidizable catalytic cracking catalyst and a hydrocarbon feed are charged to a reactor riser at catalytic riser cracking conditions to form catalytically cracked vapor product and spent catalyst which are discharged into a reactor vessel having a volume via a riser reactor outlet equipped with a separation means to produce a catalyst lean phase comprising a majority of said cracked product, and a catalyst rich phase comprising a majority of said spent catalyst, said catalyst rich phase is discharged into a dense bed of catalyst maintained below said riser outlet and said catalyst lean phase is discharged into said vessel for a time, and at a temperature, which cause unselective thermal cracking of the cracked product in the reactor volume before product is withdrawn from said vessel via a vessel outlet, the improvement comprising addition of a quenching stream into said vessel above said dense bed of catalyst, via a quench stream addition point which will allow the quench stream to contact at least a majority of the volume of the vessel above said dense bed.

In another embodiment the present invention provides a fluidized catalytic cracking process wherein a stream of hot regenerated catalyst contacts a relatively heavy hydrocarbon feed in a conventional reactor riser, and is cracked in said riser to form cracked hydrocarbon vapor products of reduced molecular weight and spent catalyst; said vapor products and spent catalyst are discharged into a vessel having a volume through a cyclone separator which produces a catalyst-rich phase which is discharged into a dense bed of spent catalyst maintained in a lower portion of said reactor vessel and a vapor phase with relatively low catalyst content which is separately discharged into said vessel above said dense bed, steam quench is added to said cracked product vapor phase via a quench steam addition point which will allow quenching of at least a majority of the volume in the vessel and quenched vapor products are removed from said vessel as a product of the process.

In another embodiment the present invention provides a fluidized catalytic cracking process comprising a conventional reactor riser wherein hot regenerated catalyst contacts a relatively heavy hydrocarbon feed and is cracked in said riser to form catalytically cracked hydrocarbon products of reduced molecular weight and spent catalyst; said cracked products and spent catalyst are discharged into a vessel through a primary cyclone separator which produces a catalyst phase containing a minor amount of said cracked product which is discharged into a dense bed of catalyst maintained in a lower portion of said vessel and a cracked product vapor phase discharged via a primary cyclone vapor outlet and wherein a quench stream is added to said vessel 0.15 to 5 meters above said dense bed and at least about 90% of said vapor phase passes from said primary cyclone vapor outlet into an inlet of a secondary cyclone within one second and said minor amount of cracked product passes from said dense bed through said vessel to said secondary cyclone inlet in a period of time in excess of one second and additional separation of entrained spent catalyst from cracked product and said quench stream occurs in said secondary cyclone to produce a cracked product and quenched stream vapor.

DESCRIPTION OF PREFERRED EMBODIMENTS

Feed

Figure 1:
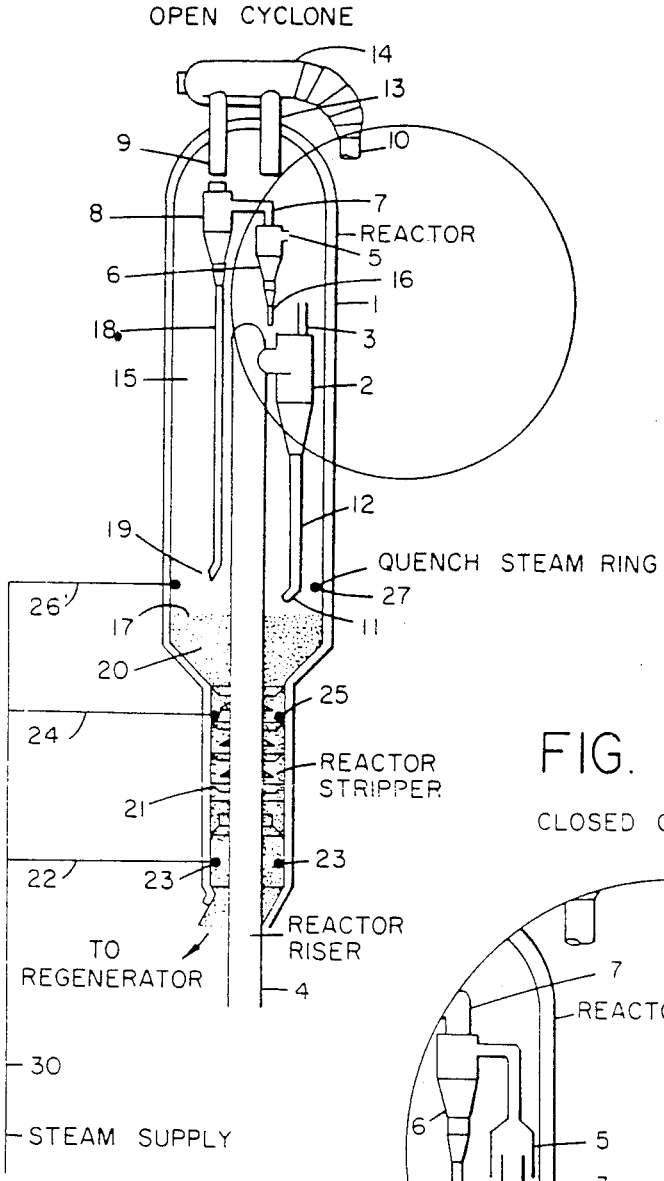
FIG. 1 shows an FCC riser reactor with quench steam ring.

Any conventional feed to an FCC unit can be used. Usually the feed to an FCC unit comprises gas oils, vacuum gas oils, topped crudes, etc. Heavy feeds, such as tar sands, shale oil, and asphaltic fractions may be used, if the unit can tolerate the high metals concentrations and coking tendencies of these feeds. The present invention is not the discovery of a new feed to an FCC unit, but a way to make better use of feeds now used for FCC units.

Catalyst

Any catalyst suitable for use in an FCC unit can be used in the process of the present invention. Preferably the catalyst is one of the many commercially available zeolite based catalysts, but it is also possible to obtain benefits from practicing the present invention when amorphous materials such as alumina, or amorphous silica/alumina are used as the catalyst.

Especially preferred catalysts are rare earth exchanged Y zeolites in an amorphous matrix. The catalyst may contain one or more of the following types of promoters.

1. CO oxidation promoters, such as disclosed in U.S. Pat. No. 4,072,600.
2. Metals passivation promoters, such as various antimony compounds.
3. Any other promoters hereafter developed for use in conjunction with FCC catalyst.

Neither the catalyst, nor any of the catalyst promoters, form any part of the present invention. The present invention helps FCC units operating with conventional catalyst to operate more efficiently.

FCC Riser Reactor

Any conventional riser reactor, and riser reactor discharge means, can be used in the present invention.

Preferably the riser reactor discharges directly into a rough cut cyclone, or other separation means, whereby a very quick separation of cracked products from catalyst may be contained.

If there's no room within the reactor to locate a rough cut cyclone on the discharge of the riser reactor, it is preferred that the riser reactor discharge down into the dense bed reactor, from a relatively high distance above the dense bed catalyst level. This minimizes stirring up of the dense bed, and minimizes contact of cracked products/catalyst.

It is also acceptable, although not preferred, if the riser reactor discharges directly into a dense bed of catalyst, either in a vertical up direction, or horizontally. Such an operation tends to promote dense bed cracking, and should be avoided. Many older FCC units were built at a time when dense bed cracking was more highly regarded, and it is not possible to economically change the configuration of the units. It is harder to see the benefits of the present invention in such units, because a lot of hot catalyst is tossed about within the vessel containing the dense bed of catalyst, minimizing the temperature quenching effect of the steam quench.

Integrating the above discussion, the preferred riser reactor provides a residence time of less than 10 seconds, preferably on the order of 1–5 seconds, and it discharges directly into a rough cut cyclone to effect rapid separation of cracked products from catalyst.

The riser reactor may operate in upflow, or downflow, though an upflow riser reactor is preferred because there is much more operating experience available for such a unit.

The riser reactor may actually be two or more reactors in series, or in parallel. Although such riser reactor designs are contemplated for use herein, they form no part of the present invention.

FCC Dense Bed Reactor

As discussed above, the riser reactor discharges into a vessel designed to contain a dense bed of catalyst. Conventional FCC dense bed reactor designs call for a relatively large vessel, usually several orders of magnitude larger in volume than the riser reactor, which serves to collect spent catalyst in the lower portion of the reactor. The spent catalyst is withdrawn from the bottom of the reactor, usually through a stripper zone containing baffles, and removed from the reactor. Stripping steam is added at the bottom of the reactor vessel to displace easily strippable hydrocarbons from the spent catalyst, so that these strippable hydrocarbons will not be burned in the regenerator.

FCC Regenerator

Any conventional FCC regenerator may be used in conjunction with the present invention.

CO afterburning regenerators are, in most situations, preferred as far as maximum efficiency in the total FCC unit is concerned, however the present invention will work equally well with CO afterburning and non-CO afterburning regenerators. The regenerator is an essential portion of an FCC unit, but the regenerator section, by itself, forms no portion of the present invention.

An especially effective regenerator design is a stacked regenerator, with a first dense bed, or coke combustor, a dilute phase transport riser, and a second dense bed of hot regenerated catalyst maintained generally above the coke combustor. Some recycle of hot regenerated catalyst to the coke combustor generally improves operation in the coke combustor.

Reactor Quench

Preferably one or more quench means are disposed within the reactor vessel into which the riser reactor discharges. Steam is the preferred quenching medium. Steam is preferably admitted via a radially disposed steam injection ring disposed just above the dense bed of catalyst.

The function of the steam quench is twofold. It reduces the temperature of the cracked products in the vapor phase above the dense bed of catalyst. It also displaces the cracked hydrocarbons from the reactor vessel, thereby decreasing the residence time of these materials in the reactor vessel. The combination of these two effects, reduction in temperature and reduction in vapor residence time, significantly reduces the amount of thermal cracking that occurs in the riser reactor.

If the steam quench rings are located too near the surface of the dense bed of catalyst, there is a risk that the hot catalyst will be stirred up by the steam injection, which will result in some catalyst displacement into the dilute phase, leading to overcracking of cracked products, and leading to increased temperatures in this zone. The generally small amounts of steam quench that are added are effective to reduce the temperature and residence time of cracked products, but we prefer not to add enough steam to reduce the temperature of the hot catalyst. This is largely a matter of economics, to significantly cool the hot catalyst would require relatively large amounts of steam, and would, in most instances, simply waste heat.

As the steam quench point rises in the reactor vessel, the effectiveness of the steam quench gradually diminishes.

The amount of steam quench injected, and the precise location of the steam quench injection point within the vessel containing the dense bed of spent catalyst, will determine the change in residence time of cracked vapors within the reactor. The temperature, and amount of steam quench will determine the temperature change of cracked product within the reactor.

The temperature of the steam will have a significant effect on the quenching effect, or temperature reduction of cracked products. It is also possible to simply add water and let the water vaporize within the reactor, or provide enough surface area in the steam quench ring so that the water will vaporize and become steam before entering the reactor. This would give maximum cooling per weight of water added, the cooling effect being vaporization of water to steam, followed by an increase in sensible heat of the steam produced.

To minimize corrosion problems, and possibilities of temperature shock within the reaction zone, it is usually preferred to simply add some low grade steam, such as 50 psig stream which is usually a very cheap and readily available commodity within a refinery.

Addition of a vaporizable liquid hydrocarbon is also possible, with naphtha and LPG being preferred. These all vaporize, and are believed at least moderately resistant to thermal cracking.

Because the optimum amount of quench will vary with each refinery unit's configuration, and indeed with different chargestocks and operating conditions, it is not possible to specify one unique quantity and temperature of quench for best results. Instead some general guidelines can be given, with the following discussion focusing the steam addition.

Improved results can be obtained when steam, or water, equivalent to about 0.1–20 wt % of the cracked hydrocarbon vapors is added to the steam quench means. Preferably, an amount of steam equal to 0.5–5 wt % of the cracked vapors is added.

In some situations, addition of this much steam will have little effect upon the temperature in the dilute phase, above the dense bed of catalyst in the reactor vessel, but even here significant operating improvements can be obtained. Whenever the riser reactor discharges into an open cyclone, there is a significant amount of hydrocarbon vapor that remains a long time in the dilute phase above the dense bed of spent catalyst. There is also some, 1–2% hot catalyst that finds its way into the dilute phase, and this hot catalyst tends to heat up the dilute phase above the dense bed. In these operations it is believed that the primary benefit of the present invention is from reduced residence time of hydrocarbon products in the dilute phase, rather than from any temperature drop, although the small drop in temperature that occurs in such an operation is certainly beneficial. It is also possible that some of the beneficial effect of our steam quench operation is one additional stage of stripping of catalyst, but this is not believed to be a significant part of the improved results seen, because well over 90 percent of the catalyst simply bypasses our steam quench ring and never sees the steam injection.

The most noticeable improvement in operation, and the greatest drop in temperature of the hydrocarbon phase above the dense bed of spent catalyst, occurs when closed cyclones are used.

In this type of operation, the riser reactor discharges into a primary cyclone, which makes a rough, but fairly effective, separation of catalyst from cracked products. The vapor from the primary cyclone is discharged directly into a secondary cyclone which is able to effect a far more complete separation of catalyst from cracked products than could be achieved in the rough cut cyclone attached directly to the riser reactor outlet.

In such a design, with closed cyclones, relatively minor amounts of steam injection result in significant decreases in reactor temperature, typically 10–20 times as great as those obtained in an open cyclone system. Despite almost an order of magnitude or more greater drop in temperature of dilute phase vapors above the dense bed of catalyst, the results as far as increased gasoline and light fuel oil make, are only slightly better than those achieved in the open cyclone case. This is because only a small portion of the vapors remain in the reactor vessel with the closed cyclone (3 wt %).

The extent of undesirable thermal cracking that goes on in a reactor may be estimated by calculating the residence time in the reactor at a given temperature. These two numbers can be used to devise an ERT or Equivalent Reaction Time at 800° F. More details about ERT are provided in U.S. Pat. Nos. 4,379,747 and 4,428,824, the entire contents of which are incorporated herein by reference. Another way of evaluating relative reaction velocities in thermal cracking is to compare S.F. or Soaking Factors. By definition, the ERT and SF are 1.0 at 800° F. As the temperature increases, the reaction rate increases, to 2.0 at 822° F., and so on.

The amount of thermal cracking will be cut about in half by reducing the residence time of the catalytically cracked product by one half, or by reducing the vapor temperature from 822° to 800° F., or some combination of these.

When closed cyclones are used, the same amount of steam injection profoundly reduces temperature and ERT, reducing ERT by more than 50%.

When open cyclones are used, much smaller declines in ERT may be expected; usually on the order of 3–50% decreases in ERT will be experienced. This is less reduction in thermal cracking severity, but 10 to 20 times the material is involved, as compared to the closed cyclone case. Thus, yield benefits are similar for both closed and open cyclone operation.

Regardless of the cyclone configuration used, the amount of quench added should be sufficient to reduce thermal cracking enough to increase the yield of gasoline and light fuel oil products at least 0.25 wt %, and preferably 0.5 to 1%, or more.

DETAILED DESCRIPTION OF THE DRAWING

The present invention may be better understood by reviewing it in conjunction with the drawing.

The drawing is schematic, many details such as instrumentation, etc. have been left out.

In FIG. 1, a mixture of hot regenerated catalyst, from a catalyst regenerator not shown, and fresh feed is mixed together and passed up through reactor riser 4. The catalyst oil mixture leaves reactor riser 4, and enters primary cyclone 2 which effects a rough separation of spent catalyst from cracked products. Most of the spent catalyst is discharged from primary cyclone 2 via dipleg 12 and flapper valve 11. Cracked vapors leave the top of cyclone 2 via outlet 3 and enter into the dilute phase 15 within reactor 1.

The terminology used in the specification is consistent with terminology used in modern refineries, however it should be pointed out that what is referred to as reactor riser 4 is in actuality the reactor where well over 90 percent of the desired catalytic cracking reactions occur. Ideally, 100 percent of the reactions would take place in reactor riser 4, and no reaction whatever would take place in reactor 1. In time, refiners may revise their vocabulary to refer to riser 4 as the reactor, and vessel 1 as a spent catalyst/cracked product separation means, but such usage would be confusing to those skilled in the FCC arts.

Vapors leaving primary cyclone 2 enter into the dilute space above the top of dense bed of catalyst 17. Dense bed 20, with upper surface or interface level 17 is the collection of catalyst from the diplegs of the cyclones within reactor 1. The dense bed/dilute phase interface 17 may be below the catalyst diplegs, as shown in the drawing, or the dense bed level may be raised, or the diplegs extended, so that the diplegs are immersed within the dense bed of catalyst 20.

Cracked product in dilute space 15, along with relatively minor amounts of catalyst entrained in the vapor phase enter the secondary cyclone means 6 via inlet 5. Catalyst fines are withdrawn via dipleg 16 and discharged into the dense bed of catalyst, although only the upper portion of the dipleg is shown in this drawing.

Cracked product vapors are removed via vapor outlet 7 from cyclone 6 and discharged into third stage separation means 8, another cyclone. Catalyst removed from the third stage cyclone is removed via dipleg 18 and discharged through flapper valve 19 into dense bed 20 of catalyst at the bottom of reactor 1.

Catalytically cracked products are removed from reactor 1 via lines 9 and 13 into reactor outlet plenum 14 and then sent via line 10 to product recovery means not shown. To simplify the drawing, only a single cyclone is shown for primary cyclone 2, secondary cyclone 6 and third stage cyclone 8. In actuality, there usually would be a plurality of primary, secondary, and third stage cyclones. The second inlet line 13 to plenum 14 is intended to show that other third stage cyclones will be present.

The spent catalyst which collects as dense bed 20 in the bottom of reactor 1 is subjected to stripping to remove easily strippable hydrocarbon vapors from the spent catalyst before it is sent to a catalyst regenerator, not shown. This steam stripping of spent catalyst, which is conventional, is conducted at reactor stripper 21. A steam supply, shown as line 30, admits steam via either line 22 and/or 24 to lower and upper stripper steam rings, respectively.

Steam is also admitted via line 26 to quench steam ring 27, located above the interface level 17 of dense bed of catalyst 20. Only a single quench steam ring is shown in the drawing, extending radially around the reactor, it is also possible to have multiple quench steam rings at different elevations within the reactor vessel 1, or to use steam injection means other than a ring. One or more stab-in steam spargers could be used to add steam, or steam may be injected to counter any naturally occurring swirl of catalyst that occurs at the bottom of the reactor.

Steam quench should be conducted so as to minimize disruption of dense bed of catalyst 20. For this reason, quench steam injection should always be at, or preferably somewhat above, the interface 17 between dilute phase 15 and dense bed 20.

The configuration shown in FIG. 1 is referred to as an open cyclone configuration, because there is no direct connection between primary cyclone 2 and secondary cyclone 6.

Figure 2:
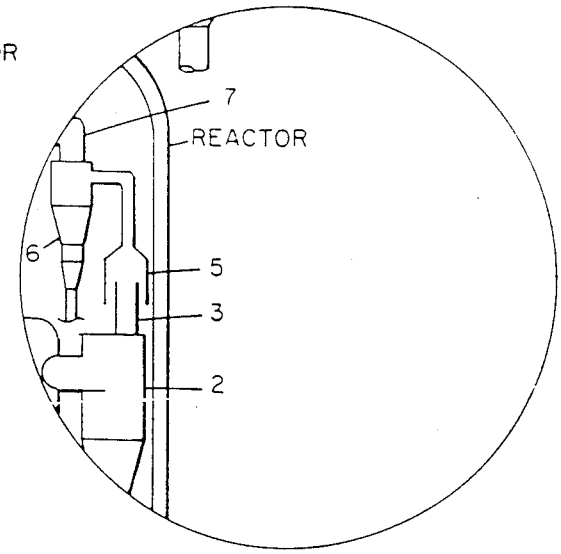
FIG. 2 shows a detail of an FCC reactor with a closed cyclone configuration and quench steam ring installed.

It is also possible, and preferable, to operate with closed cyclones, in which case inlet 5 to cyclone 6 would resemble an inverted funnel which was radially aligned with, and above outlet 3 of primary cyclone 2, as shown in FIG. 2. Such a configuration is not, strictly speaking, "closed", because it is still possible, and very desirable, for cracked hydrocarbon products, and quench steam, to enter inlet 5 in the annular space between outlet 3 and inlet 5. There has to be some way provided of allowing cracked vapor and quench steam and stripping steam to eventually enter the outlet plenum 14, and the closed cyclone modification described above works very well in this service. When operating with a closed cyclone, it is beneficial to immerse dipleg 12 about 50 cm past the dense bed/dilute phase interface 17. This minimizes leakage of vapors down dipleg 12, as the catalyst seals the outlet of dipleg 12.

A characteristic of "closed cyclone" configuration is that 90% of the cracked vapor product will pass from the primary cyclone outlet and enter the secondary cyclone inlet in less than 1 second, preferably in less than ½ second.

Although not shown in the drawing, it is also possible to eliminate entirely the primary cyclone 3, and merely have the riser reactor discharge down towards interface 17, from a distance 3–10 meters above it. This does only a mediocre job of separating catalyst from cracked vapors, but in many existing reactors, it's not possible to support primary cyclones 2 at the reactor riser outlet, either because of lack of strength or lack of room. In such circumstances, a downward discharge of spent catalyst/cracked product from 3–10 meters above the dense bed interface provides a way to achieve some semblance of quick quench of the riser cracking reaction. If such an approach is taken, it may be desirable to use multiple quench steam rings. Quench steam ring 27 shown in the drawing would reduce the residence time of cracked products in space 15, but would do little or nothing towards reducing the temperature of the cracked products, because of the large amount of hot spent catalyst present. In such a circumstance, it may be beneficial to move the quench steam ring to an elevation equal to, or slightly above the reactor riser outlet, so that steam quench will have a noticeable cooling effect on reactor vapors. In some circumstances, a combination of steam quench via quench ring 27 shown in the drawing and another quench ring located above the riser reactor outlet, and not shown in the drawing, would be beneficial.

Illustrative Embodiments

The illustrative embodiments which follow do not represent commercial tests. They are based on pilot plant data adjusted to commercial operation.

Feedstock

The feedstock used was similar to the Joliet Sour Heavy Gas Oil described hereafter.

TABLE 1

| Chargestock | Joliet Sour Heavy Gas Oil (JSHGO) |
|---|---|
| Gravity, °API | 24.3 |
| Aniline Pt., °F. | 171 |
| Sulfur, wt. % | 1.87 |
| Nitrogen, wt. % | 0.10 |
| Basic Nitrogen, ppm | 327 |
| Conradson Carbon, wt. % | 0.28 |
| Viscosity, KV at 210° F. | 3.6 |
| Bromine No. | 4.2 |
| R.I. at 70° F. | 1.5080 |
| Hydrogen, wt. % | 12.3 |
| Molecular Weight | 358 |
| Pour Point, °F. | 85 |
| Paraffins, wt. % | 23.5 |
| Naphthenes, wt. % | 32.0 |
| Aromatics, wt. % | 44.5 |
| $C_A$, wt. % | 18.9 |

TABLE II

| BASE CASE OPERATING CONDITIONS | |
|---|---|
| Fresh Feed, BPD | 34,200 |
| Combined Feed Ratio | 1.0 |
| Riser Top, °F. | 995 |
| Combined Feed, °F. | 365 |
| Regen. Dense Bed, °F. | 1,310 |
| Regen. Air, °F. | 386 |
| Reactor Press., psig | 28.0 |
| Regen. Press, psig | 31.7 |
| Cat Activity, CB FAI | 59.0 |
| Cat Circ., TPM | 28.0 |
| C/O | 7.30 |
| Stripping Steam, lb/Mlb Cat | 3.06 |
| Riser Dispersion Steam, lb/hr | 2000 |
| Regen. Air, MSCFM | 77.6 |
| $H_2$ in Coke, wt % | 6.50 |
| Coke Make, lb/hr | 26,691 |
| Air/Coke, wt/wt | 13.0 |
| $CO_2$/CO Ratio | 17,200 |
| Dome Purge Steam | Yes |

Based upon the above assumptions, and using our computer simulation of the FCC process, we calculated the effect that would be obtained by adding 4500 pounds per hour of quench steam, equivalent to about 1.125 wt % of the hydrocarbon feed to the unit.

The base case presumed that a conventional amount of purge steam (typically 500–1000 lbs/hr) is present.

TABLE III

YIELD BENEFITS FOR QUENCH STEAM RING OPEN CYCLONE ARRANGEMENT - WT %

| | Base Case | Quench Steam Ring |
|---|---|---|
| Conversion | 62.0 | −0.1 |
| Gasoline | 39.5 | +0.2 |
| LFO | 28.5 | +0.3 |
| HFO | 9.5 | −0.2 |
| $C_4$= | 5.3 | −0.1 |
| $nC_4$ | 0.6 | 0 |
| $iC_4$ | 1.6 | 0 |
| $C_3$= | 4.6 | 0 |
| $C_3$ | 1.4 | 0 |
| $C_2$— | 3.3 | −0.2 |
| Coke | 5.8 | 0 |
| Reactor Vessel Temp., °F. | 995 | 992 |
| Quench Steam Rate, lb/hr | 0 | 5000 |

As can be seen from Table III, there was a significant increase, of 0.5 wt %, in production of gasoline and light fuel oil.

There would be no significant change in the octane number of the gasoline, depending on the O.N. of catalytically cracked gasoline versus thermally cracked gasoline. It is possible that the research octane may actually drop a little because of a drop in thermal reactions whereas motor octane will not decrease.

In this example, the amount of steam quench added did little towards reducing the reactor vessel temperature, resulting in a decrease of only 3° F. from 995° F. to 992° F. This change in temperature reduces the ERT from 104 to 100. Here reactor vessel temperature refers to the vapor outlet temperature, measured at the top of the reactor. The reason the reactor vessel temperature did not change much was because in the open cyclone configuration, corresponding roughly to the one shown in the drawing, the steam is in contact with significant amounts of hydrocarbon exiting the vessel and some catalyst.

The reduction in vapor residence time in the dilute phase portion of reactor vessel 1 is estimated to be about 10–15%, or a reduction of about 4 to 6 seconds residence time. A unit weight of water occupies almost 10 times the volume of a unit weight of cracked product in the reactor, based on 18 mw for water and an assumed average mw of 180 for cracked product.

This exercise was repeated, but based upon a slightly different set of assumptions. In this simulation, a closed cyclone configuration was used, wherein more than 97% of the vapors from the primary cyclone outlet went directly into the secondary cyclone inlet. Quench steam rate was 4500 pounds per hour, equivalent to 1.125 wt % on reactor hydrocarbon feed. Again the base case yields presume that a conventional amount of dome purge steam was present. Such dome purge steam addition continued when quench steam was added.

Results of this computer simulation are reported in Table IV.

TABLE IV

YIELD BENEFITS FOR QUENCH STEAM RING CLOSED CYCLONES - WT %

| | Base Case | Quench Steam Ring |
|---|---|---|
| Conversion | 61.1 | −0.1 |
| Gasoline | 40.4 | +0.2 |
| LFO | 30.3 | +0.4 |
| HFO | 8.6 | −0.3 |
| $C_4$'s | | |
| $C_4$= | 4.9 | −0.2 |
| $iC_4$ | 1.7 | 0 |
| $nC_4$ | −0.5 | 0 |

TABLE IV-continued

YIELD BENEFITS FOR QUENCH STEAM RING CLOSED CYCLONES - WT %

| | Base Case | Quench Steam Ring |
|---|---|---|
| $C_3$'s | | |
| $C_3$= | 4.3 | −0.1 |
| $nC_3$ | 1.3 | 0 |
| $C_2$— | 2.3 | −0.1 |
| Coke | 5.8 | 0 |
| Reactor Vessel Temp., °F. | 995 | 945 |
| Quench Steam Rate, lb/hr | 0 | 4500 |
| Dome Purge Steam | Yes | Yes |

In this instance, reactor vessel temperature refers to the temperature at the top of the reactor vessel, which is not the same thing as the temperature of the vapor leaving the reactor. The vapor leaving the reactor would have a temperature of about 995° F. The supercooling of the reactor vessel dilute phase temperature by quench steam was due to the fact that the closed cyclone configuration resulted in significantly less cracked vapor and entrained catalyst being discharged into the dilute phase within reactor vessel 1. The quench steam was far more effective in cooling down this greatly reduced weight of material, in the closed cyclone configuration case, than when the quench steam was being inundated by vast amounts of cracked vapors and spent catalyst, as in the open cyclone configuration discussed in conjunction with Table III.

The reduction in severity, due to temperature change alone, is equal to 104/43.6, for reduction in thermal cracking of almost 60%.

The ½ wt % increase in valuable products is significant, because on a commercially sized unit this incremental yield translates into a projected increase in production of gasoline and light fuel oil of almost 4 million gallons per year, based on a 45,000 BPD FCC unit. The cost of adding a steam quench ring, and using low grade refinery steam, is insignificant in comparison to the increased production of gasoline and light fuel oil that can be obtained.

Dome-Steam Versus Quench Steam

In order to evaluate the effect of quench and dome steam on yields, a number of yield estimates were done using a computer simulation. These yields were estimated for a commercial FCC unit, which operated with closed cyclones. The closed cyclone system rapidly separates catalyst from cracked products exiting the riser reactor. In such a system, very little of the feed spends more than 5 seconds in the reactor vessel, while over 90% of the feed is removed from the reactor within five (5) seconds of exiting the riser.

Three modes of operation are disclosed:

1. Base Case (Prior Art)
2. Base Case+Dome Steam (Prior Art)
3. Base Case+Dome Steam+Quench (Invention).

The base case, operation with neither dome steam nor quench steam does not represent most FCC units. Most FCC's operate with 500–1000 lbs an hour of dome steam.

Dome steam was added at the rate of roughly 1000 lbs/hour. This steam was added to the dome of the reactor vessel, well above the riser outlet, riser cyclones, and catalyst stripper. The stripper is in the base of the reactor vessel.

Quench steam is the next case (the present invention) namely quench steam 10,000 lb/hr plus 1,000 lb/hr dome steam, for a total of 11,000 lbs/hr of steam.

Results of the simulations are presented In Table V.

TABLE V

| | Base Case | | Quench + Dome Steam | | Dome Steam | |
|---|---|---|---|---|---|---|
| Total Feed, TBD | 96.5 | | | | | |
| RTT, °F. | 1000 | | | | | |
| Cat/Oil | 6.5 | | | | | |
| | vol | wt. | vol | wt. | vol | wt. |
| Conv, % | 76.11 | 74.01 | −0.11 | −0.09 | −0.04 | −0.05 |
| HFO, % | 5.62 | 6.96 | −0.08 | −0.10 | −0.02 | −0.04 |
| LFO, % | 18.27 | 19.03 | +0.19 | +0.19 | +0.06 | +0.06 |
| Gasoline, % | 58.12 | 48.93 | +0.24 | +0.20 | +0.06 | +0.05 |
| G + D, % | 76.39 | 67.96 | +0.43 | +0.40 | +0.12 | +0.11 |
| C3-C4, % | 25.60 | 15.74 | −0.25 | −0.13 | −0.07 | −0.04 |
| C4—, % | | 19.96 | | −0.29 | | −0.07 |
| C2—, % | | 4.22 | | −0.16 | | −0.03 |
| coke, % | | 5.12 | | | | |

In all simulations, the feed rate, riser top temperature, and catalyst to oil weight ratio were the same.

RTT means reactor top temperature, TBD means thousand barrels per day. The plenum chamber was assumed to be present in both cases.

If these estimates had been redone for an open cyclone system (with much more traffic of catalyst and cracked products in the reactor vessel) then the effect of dome steam and of quench steam would be much less on temperature. The amount of steam would be the same, but there would be perhaps an order of magnitude more material in the reactor vessel, so the temperature quenching effect would have been much reduced.

For the the simulation presented in the above table (the closed cyclone case) the use of quench steam in an amount equal to 10,000 lbs/hr, results in a slight decrease in conversion (because there is a decrease in thermal cracking of heavy feed to lighter product), and some increase in production of gasoline and light fuel oil, and a reduction in $C_2^-$ and in $C_{3-4}$.

The above simulation (for closed cyclones) probably represents the extreme amount of quenching that could occur from the addition of dome steam only. This is because this unit is unusual in having, a moderately high amount of dome steam, a profoundly reduced amount of hydrocarbon in the reactor vessel and in the dome area, and from use of relative cool quench steam. Many refiners would try to use a relative hot steam (dry steam) stream, and add it in a modest amount. As stated in the McPherson article, "however, care should be taken ensure that the (dome) steam is dry, as unnecessary cooling of the reactor effluent at this point may only accelerate coke formation." (Page 9, of the McPherson presentation.)

Accordingly, purging of the dome of a reactor vessel in general would not lead to any significant quenching of the bulk of the cracked product in the reactor vessel. To the extent such quenching occurred, it has never been recognized or reported.

In order to achieve the benefits of quenching the reactor vessel, it is essential that a majority of the reactor volume be swept, and preferably at least 80% of the reactor volume. By reactor volume we mean the enclosed vapor space, from the top of the dome to the top of the catalyst stripper.

Most reactor vessels have a relatively uniform cross-sectional area below the dome or weld-cap. Accordingly, it is preferred to add the quench steam at an elevation from 5-50% above the distance from the top of the dense bed of catalyst in the stripper to the base of the reactor dome. If 10 meters separated the base of the dome (or base of the weld-cap or other means used to close off the top of the reactor vessel) from the normal level of catalyst in the catalyst stripper, then the quenching steam should be added at an elevation ranging from 0.15 to 5 meters—and preferably from 0.3 to 3 meters, above the top of the catalyst bed in the stripper. It is difficult to add the steam at a level much lower that this, as such the steam addition tends to stir up the catalyst entering the stripper. This catalyst is at roughly the temperature of the riser outlet, so stirring up catalyst from the top of the stripper with quench steam would tend to negate the quench effect of quench steam. It is not advisable to add the steam much higher up than 50% of the vertical distance separating the top of the catalyst stripper from the end-cap because the beneficial effect of steam quench is proportionally lost. Adding steam higher up than the 50% point leaves too much unswept or unquenched volume in the reactor vessel, but this is compensated to some extent by the somewhat lower catalyst traffic in this region of the vessel. This means that the quench steam can quench hydrocarbons more and quench spent catalyst less when steam is added higher up in the vessel.

Adding quench steam to the middle of the riser reactor, or the top of the riser reactor, would not be as effective as the present invention. This is because the entire hydrocarbon volume must be quenched and the entire weight of the catalyst must be quenched when steam is added to the riser. This means that 5-50 times as much steam would be needed to bring about the same reduction in ERT in the reactor vessel. In many FCC units it is not possible to add such large amounts of steam or other quench fluid to the riser reactor. The unit may not be designed to handle such relatively large water streams, the water stream represents some loss of energy, and the increased water traffic presents increased sour water deposal problem.

Preferably the steam quench is added at a point or points just above the catalyst bed in the stripper, in a manner which quenches the maximum volume within the reactor vessel without producing unacceptable entrainment of catalyst from the stripper into the reactor vessel. In many FCC units the level of the bed of catalyst in the stripper varies some depending on many factors (catalyst inventory, stripping steam rates, feed rate, pressure balance in the unit, etc) so the absolute level of the bed of catalyst in the top of the stripper, and the effect of adding steam at different times, will change. Thermocouples present at different elevations in the unit can be used to determine if the point of quenching condition is too low in the stripper, so that resort can be made to higher point of steam addition.

If we were designing an FCC unit today with steam quench, we would use a riser reactor with a closed cyclone configuration, i.e. one in which the riser reactor discharged directly into a primary cyclone separator. The vapor outlet from the primary cyclone separator would be closely connected with the inlet to a secondary cyclone separator, so that most of the vapor phase would very quickly leave the reactor vessel. Steam quench would be added to a steam quench ring located about 1 meter above the top of the dense bed of catalyst in the reactor. Steam quench, equivalent to 1 wt % of feed, would be added. The steam source would be 50 psig steam from a refinery steam line. Dome purge steam is preferably also added to prevent coke buildup in the dome.

What is claimed is:

1. In a fluidized catalytic cracking process wherein a fluidizable catalyst cracking catalyst and a hydrocarbon feed are charged to a reactor riser at catalytic riser cracking conditions to form catalytically cracked vapor product and spent catalyst which are discharged into a reactor vessel having a volume via a riser reactor outlet equipped with a separation means to produce a catalyst lean phase comprising a majority of said cracked product, and a catalyst rich phase comprising a majority of said spent catalyst, said catalyst rich phase is discharged into a dense bed of catalyst maintained below said riser outlet and said catalyst lean phase is discharged into said vessel for a time, and at a temperature, which cause unselective thermal cracking of the cracked product in the reactor volume before product is withdrawn from said vessel via a vessel outlet, the improvement comprising addition, after riser cracking is completed, and after separation of cracked products from catalyst, of a quenching stream into said vessel above said dense bed of catalyst, via a quench stream addition point which allows the quench stream to contact at least a majority of the volume of the vessel above said dense bed.

2. Process of claim 1 wherein said quenching stream is selected from the group consisting of water, steam and hydrocarbons.

3. Process of claim 1 wherein said quenching stream is steam.

4. Process of claim 3 wherein the amount of steam quench added to said vessel, expressed as weight percent of said hydrocarbon feed, is 0.1 to 10 wt %.

5. Process of claim 4 wherein 0.5 to 5 wt % steam is added as quench.

6. Process of claim 3 wherein said separation means comprises at least one cyclone separator connected to the reactor riser outlet.

7. Process of claim 3 wherein said separation means comprises a downwardly discharging reactor riser outlet, positioned about 3 to 20 meters above said dense bed of catalyst.

8. Process of claim 7 wherein the amount and temperature of steam quench addition to said reactor are sufficient to reduce the thermal cracking in said reactor volume, as measured by equivalent reaction time at 800° F., by at least 4%.

9. Process of claim 1 wherein said separation means comprises a primary cyclone attached to said riser outlet, and wherein a secondary cyclone is provided at an elevation above said dense bed and connective with said vessel outlet, and said quench is added to said vessel at an elevation intermediate said dense bed and said secondary cyclone.

10. Process of claim 8 wherein thermal cracking is reduced by at least 50%.

11. A fluidized catalytic cracking process wherein a stream of hot regenerated catalyst contacts a hydrocarbon feed comprising gas oils, vacuum gas oils, topped crudes, tar sands, shale oil, or asphaltic fractions in a conventional reactor riser, and is cracked in said riser to form cracked hydrocarbon vapor products of reduced molecular weight and spent catalyst; said vapor products and spent catalyst are discharged into a vessel having a volume through a cyclone separator which produces a catalyst-rich phase which is discharged into a dense bed of spent catalyst maintained in a lower portion of said reactor vessel and a vapor phase which is separately discharged into said vessel above said dense bed, steam quench is added, after riser cracking is completed, and after separation of cracked products from catalyst, to said cracked product vapor phase via a quench steam addition point which allows quenching of at least a majority of the volume in the vessel and quenched vapor products are removed from said vessel as a product of the process.

12. Process of claim 11 wherein the amount of steam quench added to said vessel, expressed as weight percent of said hydrocarbon feed, is 0.1 to 10 wt %.

13. Process of claim 11 wherein 0.5 to 5 wt % steam is added as quench.

14. Process of claim 11 wherein quench steam is added in an amount equal to at least 1 wt % of the hydrocarbon feed.

15. Process of claim 11 wherein the amount and temperature of steam quench addition to said reactor are sufficient to reduce the thermal cracking, as measured by equivalent reaction time at 800° F., by at least 4%.

16. Process of claim 11 wherein thermal cracking is reduced by at least 50%.

17. A fluidized catalytic cracking process comprising a conventional reactor riser wherein hot regenerated catalyst contacts a hydrocarbon feed comprising gas oils, vacuum gas oils, topped crudes, tar sands, shale oil, or asphaltic fractions and is cracked in said riser to form catalytically cracked hydrocarbon products of reduced molecular weight and spent catalyst; said cracked products and spent catalyst are discharged into a vessel through a primary cyclone separator which produces a catalyst phase containing a minor amount of said cracked product which is discharged into a dense bed of catalyst maintained in a lower portion of said vessel and a cracked product vapor phase discharged via a primary cyclone vapor outlet and wherein a quench stream is added, after riser cracking is completed, and after separation of cracked products from catalyst, to said vessel 0.15 to 5 meters above said dense bed and wherein there is a volume in said vessel above said dense bed and the quench stream contacts at least a majority of the volume of the vessel above said dense bed and at least about 90% of said vapor phase passes from said primary cyclone vapor outlet into an inlet of a secondary cyclone within one second and said minor amount of cracked product passes from said dense bed through said vessel to said secondary cyclone inlet in a period of time in excess of one second and additional separation, of entrained spent catalyst from cracked product and said quench stream, occurs in said secondary cyclone to produce a cracked product and quenched stream vapor.

18. Process of claim 17 wherein steam quench is added to said vessel in an amount, expressed as weight percent of said hydrocarbon feed, of 0.1 to 10 wt %.

19. Process of claim 17 wherein the amount and temperature of quench stream added are sufficient to reduce the thermal cracking in the reactor vessel, as measured by equivalent reaction time at 800° F., by at least 50%.

20. Process of claim 17 wherein said secondary cyclone inlet is substantially radially aligned with, and is over said primary cyclone vapor outlet, and wherein all of the quench stream and cracked product enter said secondary cyclone inlet with the vapor from said primary cyclone, and wherein said quenched hydrocarbon represents less than about 10% of the total amount of hydrocarbon entering said secondary cyclone.

* * * * *